US007637195B2

(12) United States Patent
O'Dwyer

(10) Patent No.: US 7,637,195 B2
(45) Date of Patent: Dec. 29, 2009

(54) SET DEFENCE MEANS

(75) Inventor: James Michael O'Dwyer, Brisbane (AU)

(73) Assignee: Metal Storm Limited, Brisbane (AU)

( * ) Notice: Subject to any disclaimer, the term of this patent is extended or adjusted under 35 U.S.C. 154(b) by 0 days.

(21) Appl. No.: 11/808,857

(22) Filed: Jun. 13, 2007

(65) Prior Publication Data

US 2008/0148925 A1 Jun. 26, 2008

Related U.S. Application Data

(63) Continuation of application No. 10/671,582, filed on Sep. 29, 2003, now abandoned, which is a continuation of application No. 10/129,004, filed as application No. PCT/AU00/01351 on Nov. 3, 2000, now abandoned.

(30) Foreign Application Priority Data

Nov. 3, 1999 (AU) ..... PQ3845

(51) Int. Cl.
*F41F 1/08* (2006.01)

(52) U.S. Cl. ..... 89/1.11; 89/127

(58) Field of Classification Search ..... 89/1.11, 89/126, 127

See application file for complete search history.

(56) References Cited

U.S. PATENT DOCUMENTS

| | | | | |
|---|---|---|---|---|
| 2,399,426 | A | 4/1946 | Bradley | |
| 3,509,791 | A | 5/1970 | Pechamat et al. | |
| 3,974,740 | A | 8/1976 | Billottet et al. | |
| 4,267,562 | A | 5/1981 | Raimondi | |
| 4,464,975 | A | 8/1984 | Terry et al. | |
| 4,617,750 | A | 10/1986 | Garehime, Jr. | |
| 4,709,615 | A | 12/1987 | Field | |
| 4,848,236 | A | 7/1989 | Hembise | |
| 5,153,372 | A | 10/1992 | Deuss et al. | |
| 5,187,322 | A | 2/1993 | Schloss et al. | |
| 5,261,328 | A | 11/1993 | de la Haye | |
| 5,279,229 | A | 1/1994 | Bredy et al. | |
| 5,497,705 | A | 3/1996 | Bredy et al. | |
| 5,659,148 | A * | 8/1997 | Isgen | 89/14.05 |
| 5,834,675 | A * | 11/1998 | Boss | 89/6.5 |

(Continued)

FOREIGN PATENT DOCUMENTS

| | | |
|---|---|---|
| AU | 62790/94 | 9/1994 |

(Continued)

OTHER PUBLICATIONS

Office Action dated Mar. 28, 2003 for prior application, U.S. Appl. No. 10/129,004.

(Continued)

*Primary Examiner*—Troy Chambers
(74) *Attorney, Agent, or Firm*—Blakely Sokoloff Taylor & Zafman LLP

(57) ABSTRACT

A set defence means for defending a designated area including, at least one monitor for monitoring the designated area to detect any zone therein in which a new presence appears, defence capable of debilitating personnel present anywhere in a remote designated area and communication means providing communication between the monitoring means and the defence means for triggering selective activation of the defence means for delivering a debilitating attack to the detected zone.

17 Claims, 12 Drawing Sheets

U.S. PATENT DOCUMENTS

| | | | | |
|---|---|---|---|---|
| 5,936,183 | A | 8/1999 | McNulty, Sr. | |
| 6,014,932 | A | 1/2000 | Mardirossian | |
| 6,269,726 | B1 | 8/2001 | McNulty, Sr. | |
| 2006/0005733 | A1 * | 1/2006 | Rastegar et al. | 102/513 |

FOREIGN PATENT DOCUMENTS

| | | | |
|---|---|---|---|
| DE | 35 36 328 | A1 | 5/1985 |
| DE | 39 20 973 | A1 | 1/1991 |
| DE | 40 29 898 | A1 | 3/1992 |
| FR | 2205186 | | 5/1974 |
| FR | 2518734 | | 6/1983 |
| FR | 2571842 | | 4/1986 |
| FR | 2622964 | | 5/1989 |
| FR | 2646232 | | 10/1990 |
| FR | 2676536 | | 11/1992 |
| FR | 2704051 | | 10/1994 |
| GB | 1376018 | | 12/1974 |
| GB | 2103341 | | 2/1983 |
| GB | 2230845 | | 10/1990 |
| WO | WO 94/20809 | | 9/1994 |
| WO | WO 97/04281 | | 2/1997 |
| WO | WO 98/17962 | | 4/1998 |
| WO | WO 00/62005 | | 10/2000 |
| WO | WO 01/33253 | | 5/2001 |

OTHER PUBLICATIONS

Supplementary European Search Report for European Application No. EP 00992950.

* cited by examiner

Minefield Replacement Concept

| | Weapon | Range | Maximum Simultaneous | Maximum Rate of Fire | Magazine | Dimensions | Weight Loaded |
|---|---|---|---|---|---|---|---|
| A | Line-of-Sight 9mmclose-in Pod | 91m | 192 | 8.4M spm | 768 | 100x305x150mm | 16kg |
| B | Line-of-Sight 25mm Air-Burst Pod | 1829m | 100 | 600,000 spm | 800 | 355x355x1525mm | 508kg |
| C | 40mm Grenade Box 0.5 lb. Grenade | 1554m | 98 | 300,000 spm | 588 | 305x760x610mm | 204kg |
| D | 81mm Mortar Box 9 lb Bomb | 5669m | 36 | 110,000 spm | 144 | 610x610x2130mm | 1315kg |
| E | 160mm Mortar Box 96 lb Bomb | 5120m | 16 | 9,600 spm | 48 | 760x760x3660mm | 2450kg |
| F | Helicopter (Stand-Off) Area Denial 40mm Grenade Pods | | 500 | 1.5M spm | 3,000 | 305x760x1525mm | 1089kg |
| G | A-10 (Stand-Off) Area Denial 40mm Grenade Pods | | 1,764 | 5.2M spm | 10,584 | 460x760x3660mm | 3674kg |
| H | Vehicle Mounted Anti-Ambush 40mm Grenade Circle | 1554m | 330 | 1M spm | 2,500 | 1.8mDiam.x 460mm Deep | 907kg |
| J | Man portable Repeatable 9mm Claymore | 18.3m | 64 | 2.8M spm | 256 | 100x100x150mm | 6.4kg |

AMENDED SHEET

FIG. 9

Minefield Replacement Concept

| | Weapon | Range | Maximum Simultaneous | Maximum Rate of Fire | Magazine | Dimensions | Weight Loaded |
|---|---|---|---|---|---|---|---|
| A | Line-of-Sight 9mm Close-In Pod | 100 yds. | 192 | 8.4M spm | 768 | 4" x 1' x 6"L | 36 lb. |
| B | Line-of-Sight 25mm Air-Burst Pod | 2,000 yds. | 100 | 600,000 spm | 800 | 14' x 14" x 5'L | 1,120 lb. |
| C | 40mm Grenade Box 0.5 lb. Grenade | 1,700 yds. | 98 | 300,000 spm | 588 | 1' x 2'6" x 2'L | 450 lb. |
| D | 81mm Mortar Box 9 lb. Bomb | 6,200 yds. | 36 | 110,000 spm | 144 | 2' x 2' x 7'L | 2,900 lb. |
| E | 160mm Mortar Box 96 lb. Bomb | 5,600 yds. | 16 | 9,600 spm | 48 | 2'6" x 2'6" x 12'L | 5,400 lb. |
| F | Helicopter (Stand-Off) Area Denial 40mm Grenade Pods | -- | 500 | 1.5M spm | 3,000 | 1' x 2'6" x 5'L | 2,400 lb. |
| G | A-10 (Stand-Off) Area Denial 40mm Grenade Pods | -- | 1,764 | 5.2M spm | 10,584 | 1.5' x 2.5' x 12'L | 8,100 lb. |
| H | Vehicle Mounted Anti-Ambush 40mm Grenade Circle | 1,700 yds. | 330 | 1M spm | 2,500 | 6' Diam. x 18" Deep | 2,000 lb. |
| J | Man portable Repeatable 9mm Claymore | 20 yds. | 64 | 2.8M spm | 256 | 4" x 4" x 6"L | 14 lb. |

Weights are calculated for limited-use or single-use Composite Barrel Materials.
Applications F & G can be configured as multiple-pass Loitering Cruise Missiles.

Fig. 12

SET DEFENCE MEANS

This is a continuation of application Ser. No. 10/671,582, filed Sep. 29, 2003, now abandoned which is a continuation of application Ser. No. 10/129,004, filed Sep. 12, 2002, now abandoned which is the National Stage of International Application No. PCT/AU00/01351, filed Nov. 3, 2000, and amended on Nov. 14, 2001, the contents of all of which are relied upon and incorporated herein by reference; further, Applicants claim the right of priority under 35 U.S.C. § 119 based on patent application No. PQ 3845, filed Nov. 3, 1999, in the Australian Patent Office.

This invention relates to defence means. In particular this invention relates to set defence means for defending a designated area.

Conventional set defence means for defending a designated area is by, placement of concealed land mines throughout the designated area. These land mines are normally placed randomly throughout the designated area.

This form of set defence has been widely used in the past and unfortunately it has resulted in many past war zones remaining mined long after peace has returned to the zone. This often renders good fertile land unusable and causes widespread injury to innocent civilians.

Furthermore areas which are mined are not normally mined with a view to preventing all personnel passing beyond the mined zone. Typically areas are mined so that the likelihood of personnel being injured is high. This acts as an effective deterrent to ingress upon the mined zone. To this end, the mines are arranged randomly and not on any fixed grid spacing as any fixed arrangement would enable relatively simple clearing of a mined site.

Typically persons who may be considered as dispensable in a war situation may be induced to pass through the mined area to establish a safe path for the following army. Likewise, mines may be cleared from a relatively narrow path through the mine zone in order to render the mining ineffective for preventing an enemy breaching the mined zone.

Unfortunately the random placement of the mines make them difficult if not impossible to recover at a later date.

This invention aims to provide set defence means which will alleviate at least one of the abovementioned disadvantages.

With the foregoing in view, this invention in one aspect resides broadly in set defence means for defending a designated area including:

at least one monitor for monitoring the designated area to detect any zone therein in which a new presence appears;

defence including multi-barrel weapons each having barrels loaded with multiple sequentially fired projectiles selectively fired by electronic controls and capable of debilitating personnel or vehicles present anywhere in a remote designated area; and communication means providing communication between the monitor and the defence for triggering selective activation of the defence for delivering a debilitating attack to the detected zone.

The monitors include one or more on-site sensors deployed in the designated area or remote sensing means deployed remote from the designated area. Alternatively the monitoring means may include both on-site and remote sensing means.

The monitoring means may also provide a visual display of the monitored designated zone so that manual override means may be actuated, if desired, to enable manual control of the set defence means.

Preferably the defence is adapted for inconspicuous placement, however in some applications conspicuous defence may be utilised as a deterrent. The defence may be any suitable arrangement of conventional weapons such as machine guns, grenades and rocket launchers, cannons, or combinations thereof.

Suitably the set defence means comprises or includes multi-barrel weapons each having barrels loaded with multiple sequentially fired projectiles selectively fired by electronic controls and more preferably of the general type described and or illustrated in my earlier International Patent Applications Nos. PCT/AU94/00124, PCT/AU96/00459 and PCT/AU97/00713.

This preferred arrangement provides the advantage of the set defence means being relatively transportable and compact and thus easily concealed while providing the ability to deliver relatively large numbers of projectiles to the detected zone in a very short space of time.

The set defence means can also be of a one-use disposable type enabling size optimization to be more easily achieved and also providing cost benefits. This has benefits over conventional weapons in that each set defence module is free of ammunition feed and ejection systems, breech opening or mechanical operation. This enables each defence module to be self contained in a compact shell or container which may be partially buried readily deployed without much concern.

In order that this invention may be more readily understood and put into practical effect, reference will now be made to the accompanying drawings which illustrate typical embodiments of the invention wherein:

FIG. 1 is a diagrammatic layout of a typical installation;

FIG. 2 provides a diagrammatic perspective view of the embodiment Illustrated in FIG. 1;

FIG. 9 is a table listing different weapon types and their relevant criteria.

Figure 1:
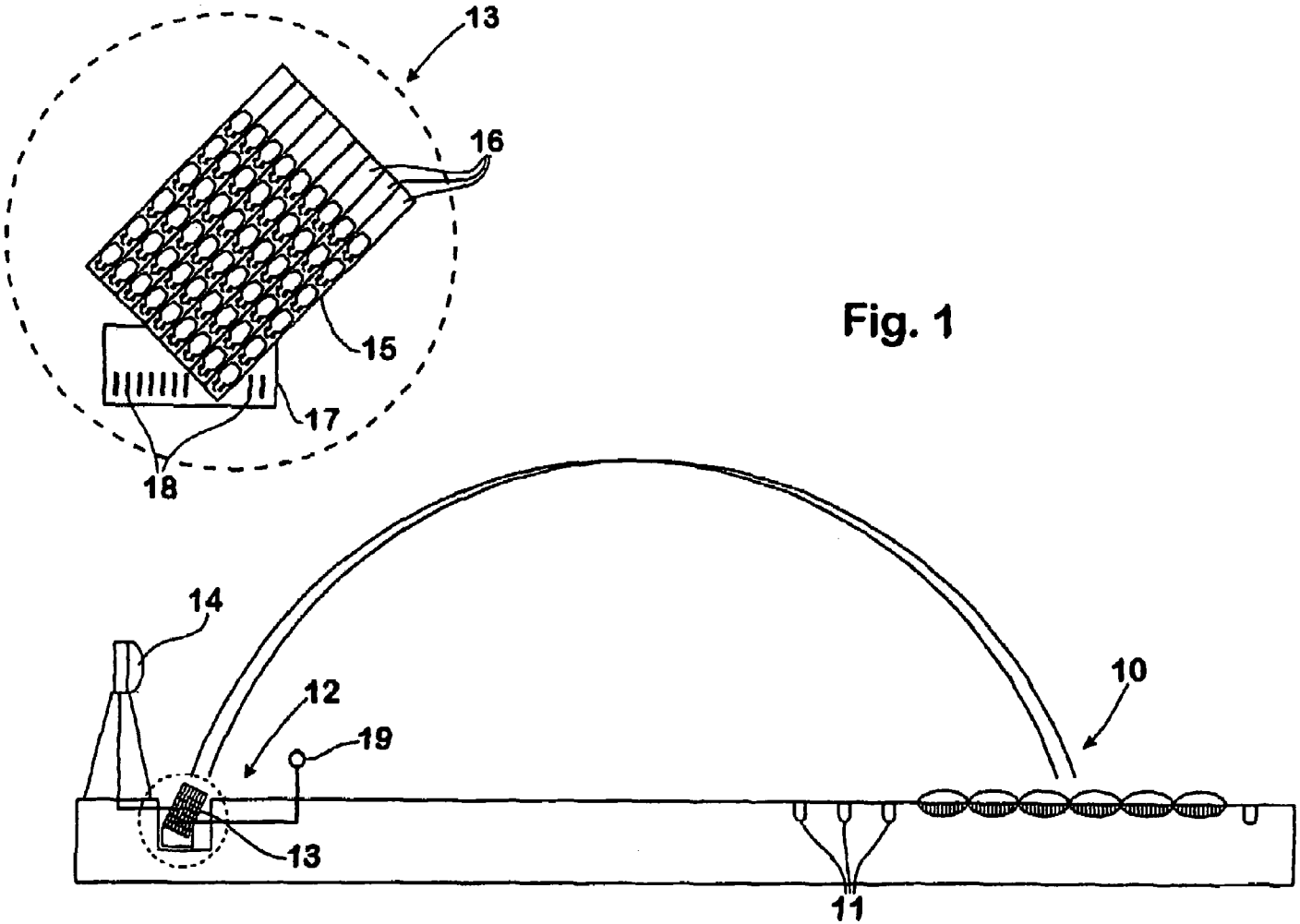
Figure 2:
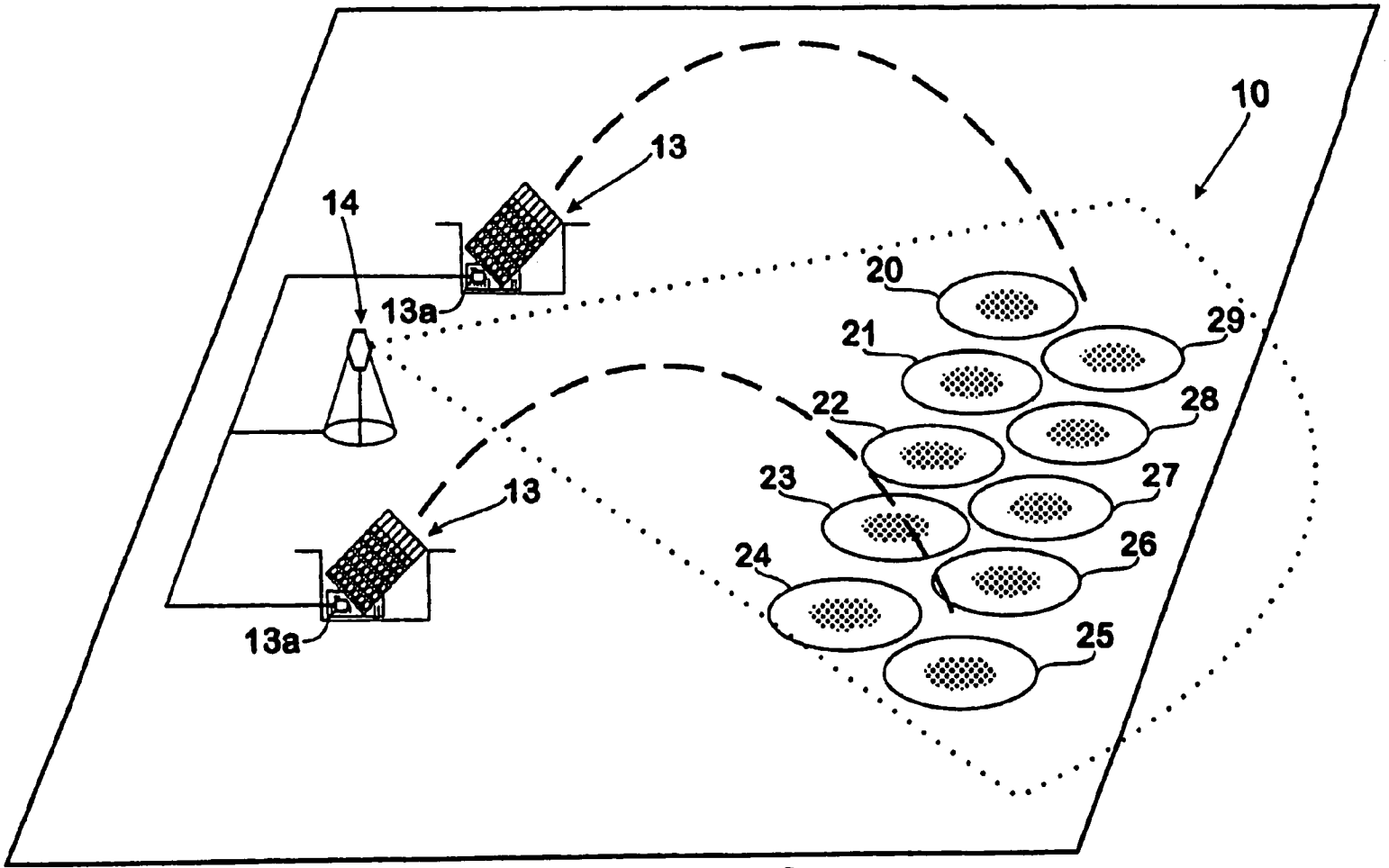

Referring initially to FIGS. 1 and 2, it will be seen that a designated area 10 to be defended is monitored by an array of field sensors 11 distributed over the designated area and which may be of any suitable type such as pressure, acoustic or seismic type sensors.

The illustrated set defence means 12 is in the form of a pair of grenade boxes 13 each of which is substantially identical and coupled to a remote sensing means 14 which is this embodiment is tower mounted and adapted to sweep the designated area 10 to monitor any intrusion into the designated area by a personnel or vehicles.

The sensor unit 14 is adapted to receive signals from the array of field sensors 11 such that upon any such intrusion the zone of the intrusion will be isolated for targeting by grenades fired from the grenade boxes 13. It will be seen that each grenade box 13 is located in a substantially concealed position in the ground and of course once set up the hole in which the grenade box 13 is placed may be back filled without causing any detrimental effects to the operation of the grenade box.

Typically the grenade box 13 has an outer case in which the weapon is delivered to the front and which includes a lower casing portion 15 supporting the barrels 16 and which remains as an integral part of the weapon. An upper removable lid assembly 17, when removed, forms an adjustable base mounting for setting the trajectory and direction of the grenades launched therefrom.

For this purpose screw jacks 18 or the like may be coupled between the base mounting 17 and the lower casing portion 16 to adjustably set the trajectory. A turret type mounting may also be provided to aim the barrels 16. The hole in which the box 13 may be backfilled to substantially bury the grenade box 13 to provide substantial concealment and stabilization of the weapon.

Typically the weapon illustrated contains 588 grenade carrying projectiles contained six to a barrel with the box containing a stack of 98 barrels in rows of side by side barrels. It is considered that such a box for 40 mm grenades would be in the order of 600 mm square in cross-section and 750 mm deep.

A small control circuit provided as a plug-in connection to the grenade box 13 is fitted on-site but not during transport so as to maintain safety of the weapon during transport. Once fitted, the weapon is armed and ready to fire in accordance with signals provided by the sensor unit 14.

In use, if an intrusion into the detected area is detected at a zone, such as any one of the zones indicated as 20 to 29 in FIG. 2, the selected grenade box 13 can be activated by the control circuit to fire one or more grenades into that particular zone. For this purpose, the barrels of the weapon may have an inbuilt aiming system providing sufficient variation for selection of any one of the target zones at a respective side of the designated area.

Alternatively the grenade boxes 13 may be such that in the operative range of say 100 m to 1500 m. The grenades launched from the lower left hand tubes or barrels will reach the near left hand corner of the designated area. The grenades launched from upper left hand barrels will reach the far corner of the designated area and those launched from the corner barrels at the right hand side of the box will reach the near and far portions at the middle of the designated area.

In this manner, selected barrels can be activated to fire grenades to the desired zone. For this purpose, the barrels can be disposed with their axes parallel or splayed to achieve the desired target impact pattern.

From the above it will be seen that if desired, all barrels may be simultaneously activated to fire one round so that all of the designated area is shelled with grenades. Alternatively, one grenade may be fired to any zone in which a presence is detected. Then again, that zone or all zones may be subject to any selected number of grenades up to the six contained in each barrel. If desired, all of the grenades may be despatched to each or all of the designated zones in a fraction of a second.

The grenade boxes 13 utilise the inventions disclosed in my previous International Patent Applications which provide simple and effective means of stacking multiple electrically fired projectiles in individual or groups of barrels, being free of feed or ejection systems or any mechanical operation.

The grenade boxes may be buried just below the ground or their upper end may be open and concealed by suitable camouflaging ingress of water or other contaminants into the backfill or the hole into which the grenade box is located will not affect the operation of the grenade box.

Thus it will be seen that such grenade boxes can be quickly deployed in a war zone and connected to on-site or remote sensors to provide a hands free defended zone which will perform the functions of a minefield without having the disadvantage of remaining permanently after the defence is not required. In this respect, at any time the grenade boxes may be easily removed as a unit when not required.

Correspondingly, they may be easily replaced and if desired, a plurality of grenade boxes may be located in each site such as in a trench with suitable controls to have them fire in series so that after one grenade box 13 is depleted of its grenades, the next is activated.

Furthermore, if desired, the leading rounds of a grenade box may contain sensors which are fired upon installation of the grenade boxes so as to locate the infield sensors in the actual position to which the grenades will be fired from that barrel. Thus, designated areas may be set with an array of field sensors for subsequent activation of the remaining rounds of the particular or associated grenade boxes.

Figure 3:
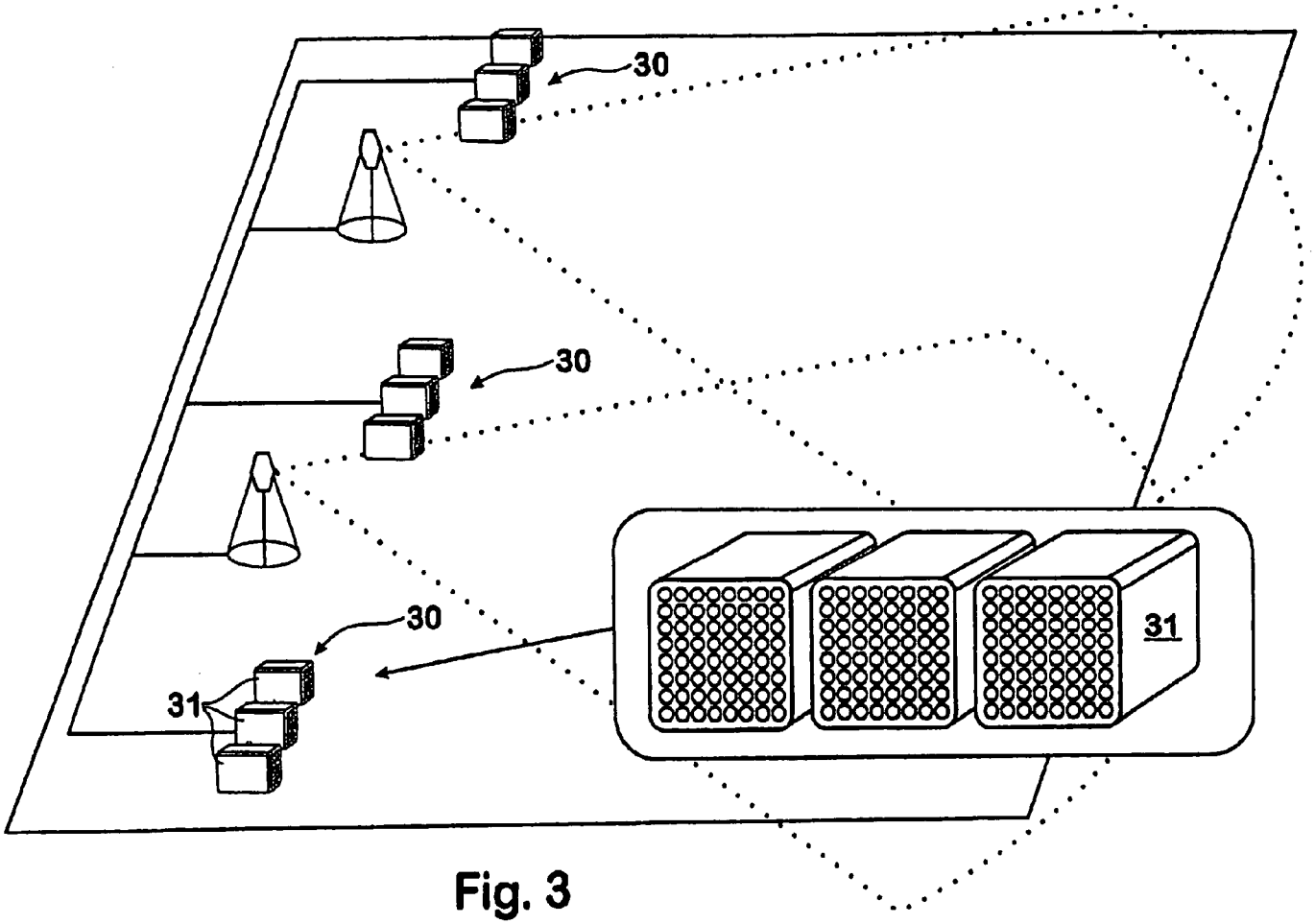
FIG. 3 is a diagrammatic perspective view of an alternate layout.

In the embodiment illustrated in FIG. 3, the grenade boxes are replaced by banks of weapons 30 which are configured as kinetic close range solid state gun systems and which in the illustrated embodiment, fire 9 mm rounds across the designated area.

Figure 4:
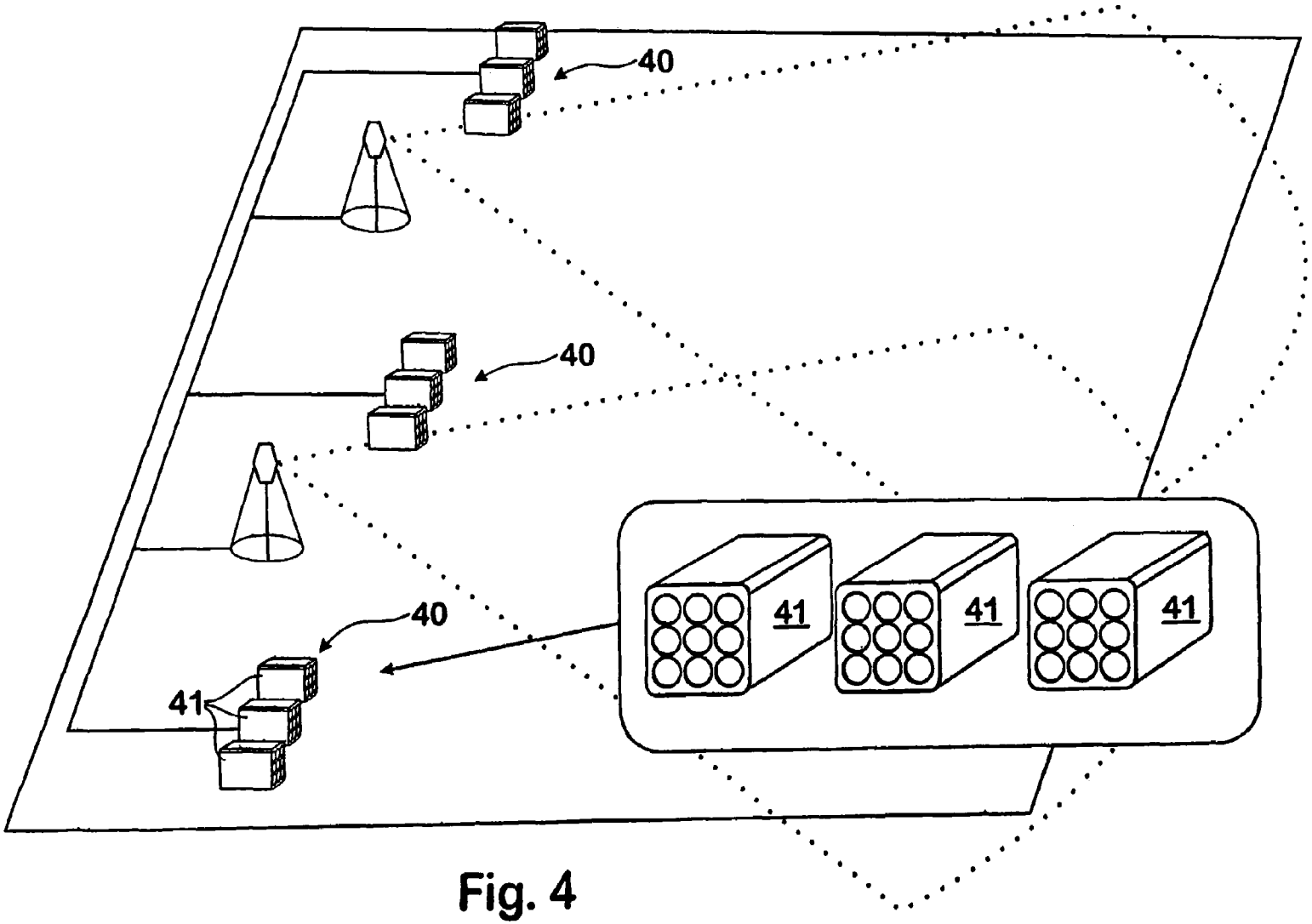
FIG. 4 is a view which is similar to FIG. 3 but illustrates alternate forms of set defence means.

In the embodiment illustrated in FIG. 4, the weapons 40 fire air burst 25 mm rounds onto the target zones. The air burst rounds are adapted to explode at a low level above the ground such as at about 1 m to 3 m.

Of course, the grenade boxes 13 may be used in combination with the kinetic rounds, air burst rounds or other special purpose rounds so as to suit the particular situation which may have varying terrain and include bodies of water and in such instances, the type of round can be selected to suit the terrain at each particular zone.

Figure 5:
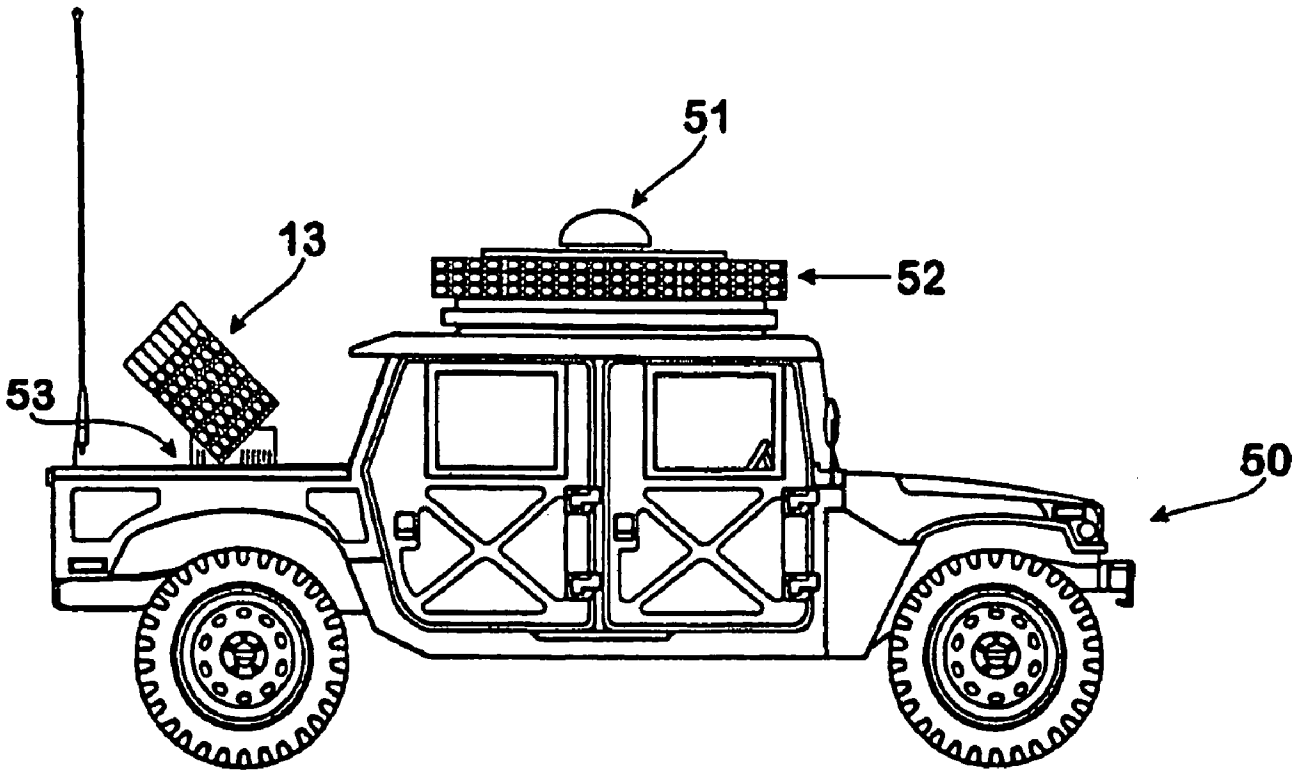
FIG. 5 illustrates a further embodiment of the invention in which the said defence means and the remote monitoring means are deployed on a vehicle.

Additionally, the weapons can be carried on a vehicle such as a wheeled vehicle 50 in FIG. 5 or a tracked vehicle. In the wheeled vehicle 50, a grenade box 13 is supported in a turreting platform 53 on the tray of the utility while the roof supports the target acquisition sensors 51 and grenade dispensers 52 fired horizontally from the roof of the vehicle 50.

Figure 6:
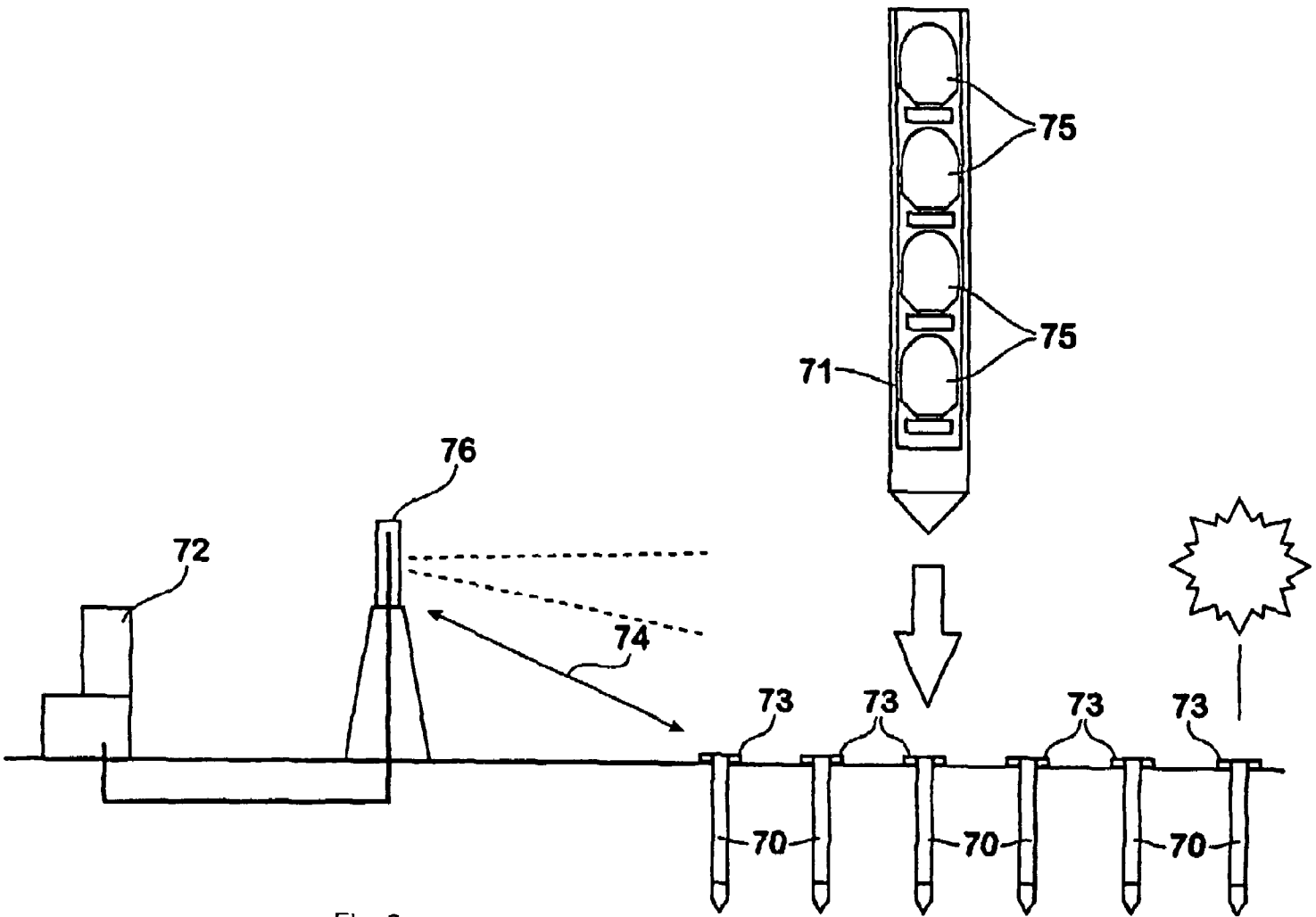
FIG. 6 illustrates an installation in which the defense means provided with permanent in-ground mountings in the designated area with reloadable inserts.

According to a further embodiment which could be particularly suited to defending an area such as the perimeter of an airfield or the like, such as illustrated in FIG. 6, the designated area contains permanent in-ground launching cases 70, each of which is adapted to receive removable inserts 71 of multiple projectile barrels to suit the particular purpose. For example, the projectiles may contain air burst grenades 75 adapted to explode several meters above the ground for use as anti-personnel defences. Alternatively, the projectiles may be adapted to explode at a higher level for anti-aircraft defence. Preferably the in-ground cases are installed permanently and are armed or disarmed as required by inserting or removing the removable barrel insert.

Figure 7:
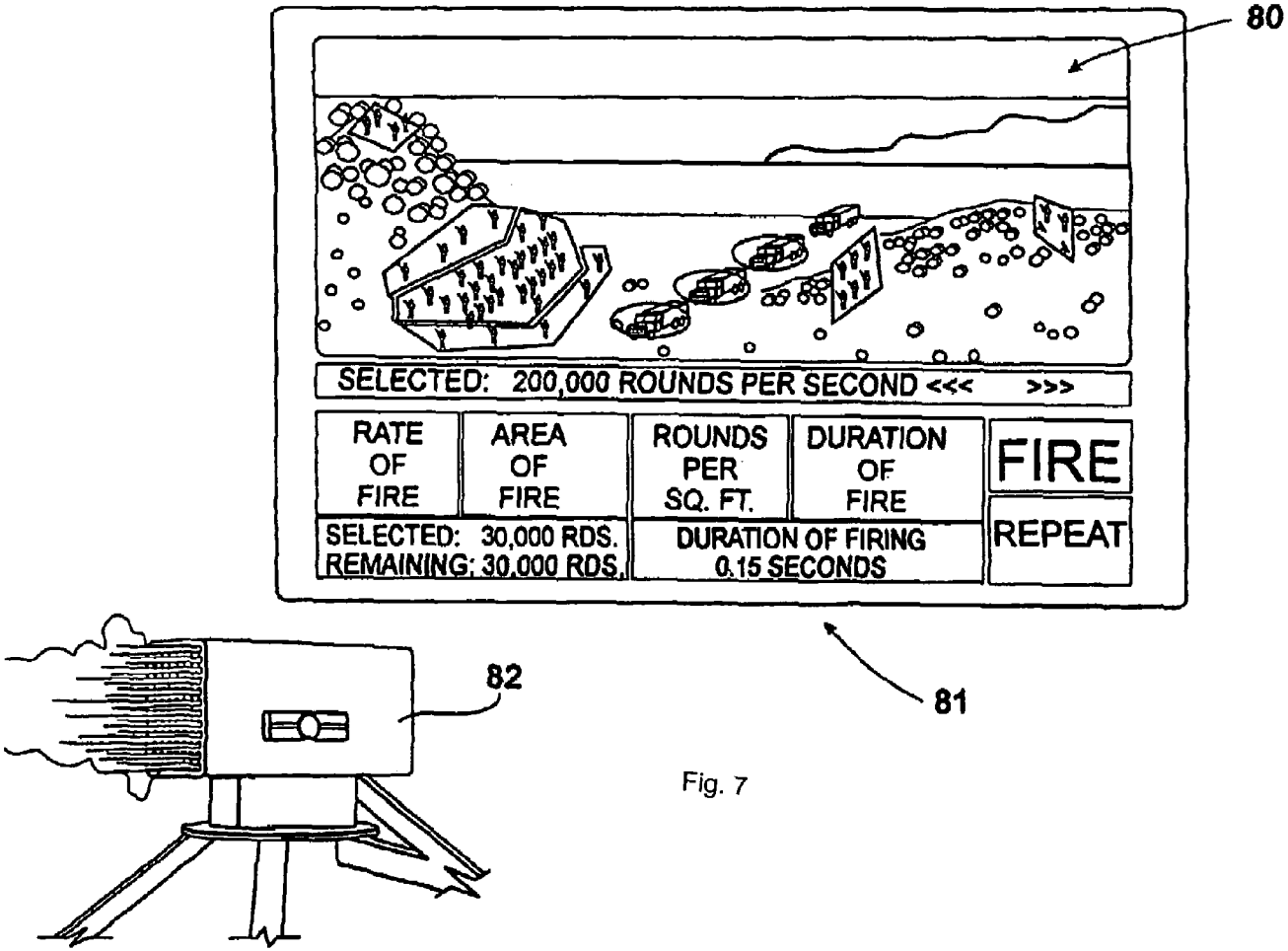
FIG. 7 illustrates a remote visual display monitor for a manual override control of the defence means.

Additionally, in this embodiment, as in the earlier embodiment, manned stations may be provided to override the automatic controls and as illustrated in FIG. 7, the ground control may have a screen 80 for video surveillance cameras which monitor the designated area and suitable control means 81 which enables an operator to highlight the visible area in the screen where troops or vehicles are intruding for automatic firing of a barrel of a selected weapon 82 which will target those areas.

As illustrated, the screen may include rate of fire, area of fire, density of fire and duration of fire or other controls such as type of round to be despatched to the targeted zone.

Furthermore, the rounds may be delivered from pods supported by aircraft provided with remote control from the minefield sensors such that a manned or unmanned aircraft may deliver the grenades or other grounds to the target zone indicated by the monitoring means.

Figure 8:
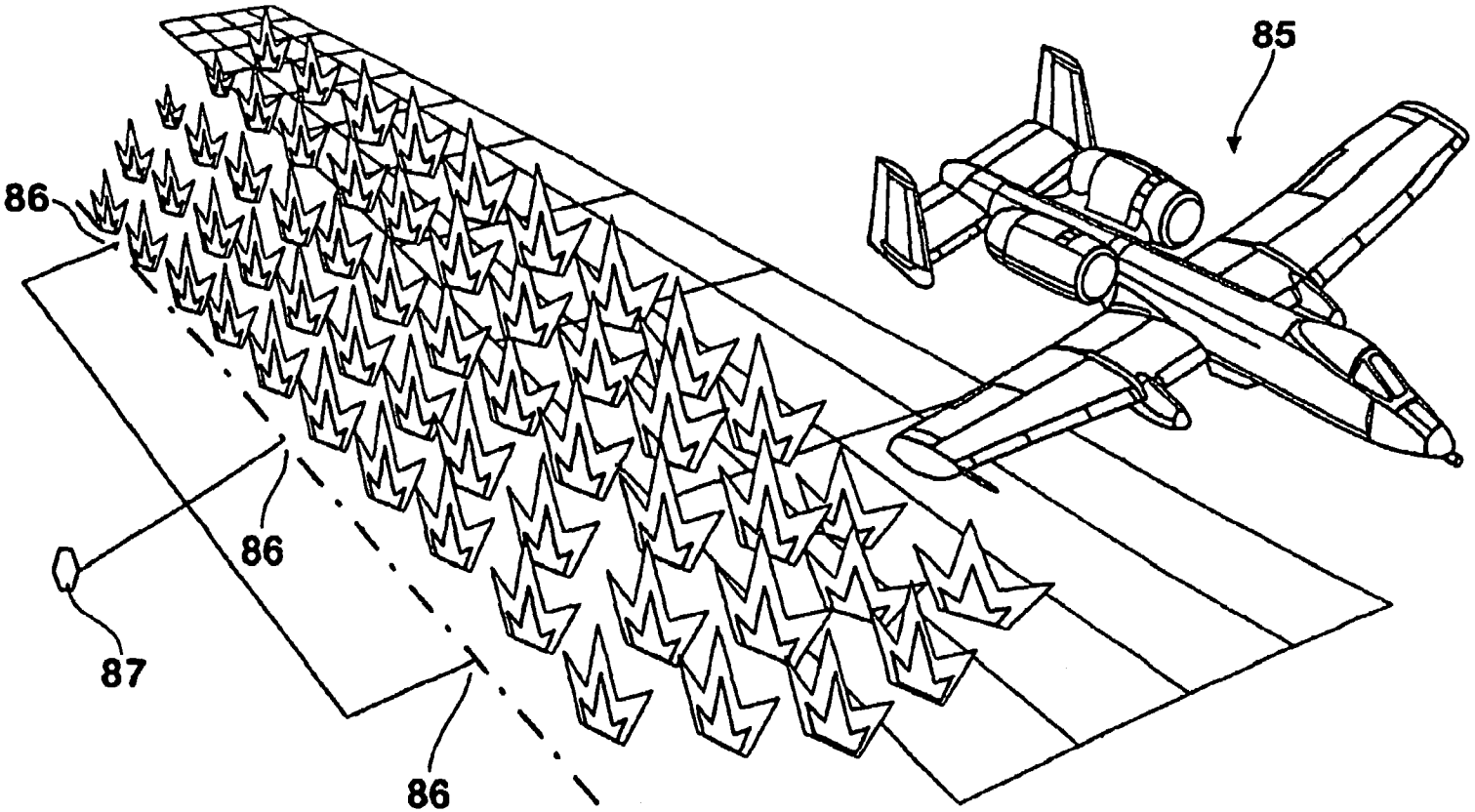
FIG. 8 illustrates yet a further embodiment in which the defence means is delivered by an aircraft.
Figure 10:
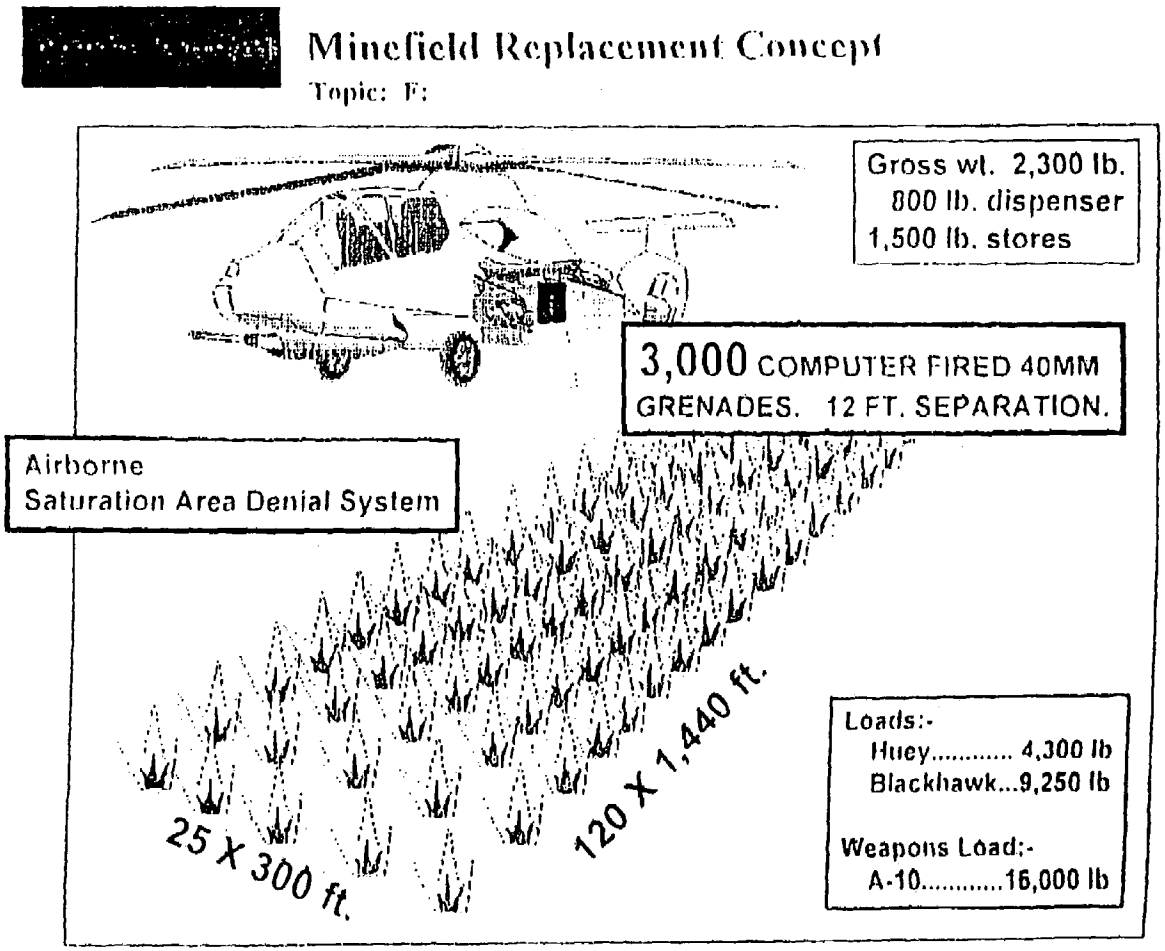
Figure 11:
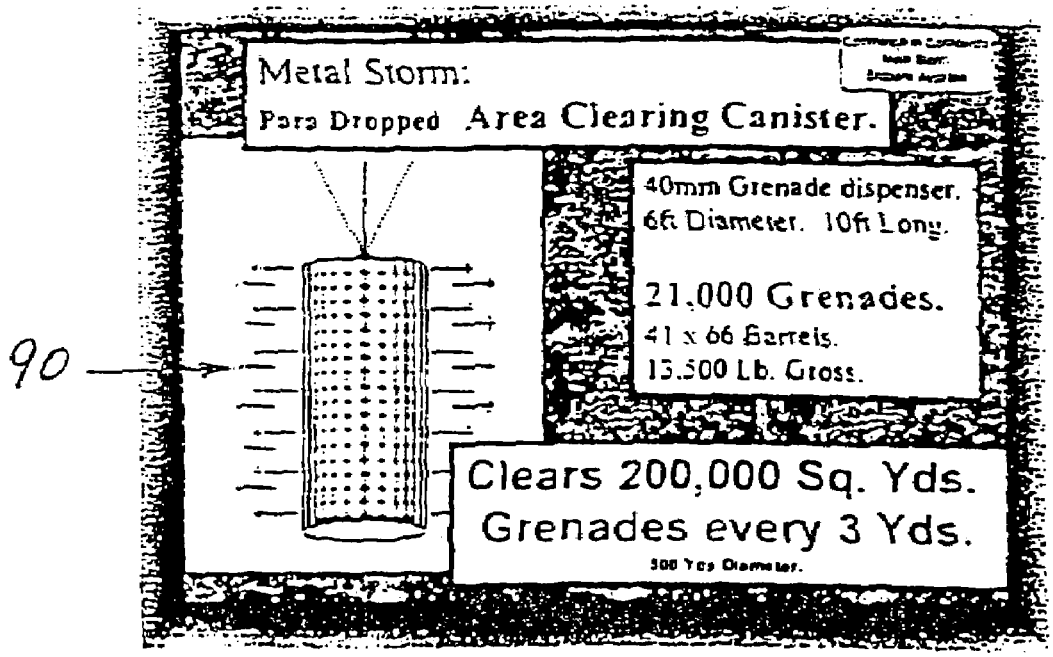

FIG. 8 illustrates how a plan and/or a helicopter may be used to support the weapons for discharging a fixed array of rounds onto a target zone. A fixed wing ground attack aircraft 85, such as the Fairchild A-10 "Thunderbolt," when fitted with 4 grenade pods, can deliver 21,168 grenades from 3,528 barrels or tubes at any desired rate up to 10.4M spm. In the illustrated arrangement, there are provided minefield boundary sensors 86, together with a fire control station 87 uplinked to the aircraft 85.

Alternatively, a grenade box may be of a cylindrical form provided with barrels radiating from a central control core which may be either mounted on the ground or dropped by a parachute, but again with control from the monitoring means so that the rounds may be dispatched to the designated target zone.

Each barrel assembly may have multiple grenade carrying projectiles of substantially known form loaded in rifled barrels to impart spin upon firing for activating the arming device.

However the rupturable propellant cup is fixed to the projectile for flight therewith.

In use, as per my earlier inventions, loading of the projectiles forms wedge type seals at the leading and trailing ends of a sleeve 118 while firing releases the leading seal but maintains an operative seal at the rear end of the sleeve. As the pressure projecting the projectile is relative low, in the order of 3000 psi, only minimal sealing is required.

FIG. 9 lists typical weapons which may be used with the present invention indicating range, the number of simultaneous rounds which may be dispatched, the maximum rate of fire, the total number of rounds per weapon, the envisaged overall dimensions and envisaged overall weight.

It will of course be realised that the above has been given only by way of illustrative example of the invention and that all such modifications and variations thereto as would be apparent to persons skilled in the art are deemed to fall within the broad scope and ambit of the invention as is herein set forth.

The claims defining the invention are as follows:

1. A defense system for an area, comprising:

a weapon having multiple barrels that are trained on respective zones, each barrel being loaded with a sensor and multiple projectiles that are sequentially selected and fired, a sensor system including a plurality of the sensors for detecting intrusions in respective zones, the sensors being located throughout the area by firing the sensors from respective barrels to determine the respective zones, and a firing controller that receives signals from the sensor system and triggers the weapon so that projectiles are fired into one or more of the zones in which an intrusion is detected.

2. A system according to claim 1, wherein the firing controller requires intervention of an operator in response to the signals from the sensor system in order to trigger the weapon.

3. A system according to claim 1, wherein the weapon is located remote from the area and the barrels have fixed or variable orientations that target respective zones.

4. A system according to claim 1, wherein one or more of the barrels contain a range of projectiles for different purposes.

5. A system according to claim 1, wherein the weapon is a grenade box or barrel block configured to be concealed in the ground.

6. A system according to claim 1, wherein triggering simultaneously fires one projectile from all barrels when an intrusion is detected in a zone.

7. A system according to claim 1, further including a monitor for monitoring the land area from a remote position.

8. A system according to claim 1, wherein the weapon is configured to be dropped in place from an aircraft or vehicle for defense of the area.

9. A system according to claim 1, wherein the barrels are in parallel orientation or wherein the weapon is in a cylindrical form with the barrels radiating from a central core.

10. A weapon for defense of an area, comprising:

a container containing a plurality of barrels, each barrel containing a sensor and a series of projectiles for sequential firing, and a firing controller that fires the sensors from the barrels into the area to define zones for detection of intrusions, and that fires one or more projectiles from the barrels into the zones upon receiving signals from the respective sensors.

11. A weapon according to claim 10, wherein said weapon is configured to be dropped in place from an aircraft or vehicle for defense of a land area.

12. A weapon according to claim 10 wherein the barrels are in parallel orientation or wherein the box is in a cylindrical form with the barrels radiating from a central core.

13. A weapon according to claim 10, wherein the controller simultaneously fires one projectile from all barrels when an intrusion is detected in a zone.

14. A weapon according to claim 10, wherein the firing controller requires intervention of an operator in response to the signals from the sensor system in order to trigger the weapon.

15. A weapon according to claim 10, wherein the weapon is configured to be located remote from the area and the barrels have fixed or variable orientations that target respective zones.

16. A weapon according to claim 10, wherein one or more of the barrels contain a range of projectiles for different purposes.

17. A weapon according to claim 10, wherein the weapon is a grenade box or barrel block configured to be concealed in the ground.

* * * * *